US009004837B2

(12) United States Patent
Friese

(10) Patent No.: US 9,004,837 B2
(45) Date of Patent: Apr. 14, 2015

(54) METHOD AND DEVICE FOR PRESSING A BOOK BLOCK

(75) Inventor: Thomas Friese, Leipzig (DE)

(73) Assignee: Mueller Martini Holding AG, Hergiswil (CH)

( * ) Notice: Subject to any disclaimer, the term of this patent is extended or adjusted under 35 U.S.C. 154(b) by 419 days.

(21) Appl. No.: 13/325,360

(22) Filed: Dec. 14, 2011

(65) Prior Publication Data

US 2012/0155991 A1 Jun. 21, 2012

(30) Foreign Application Priority Data

Dec. 15, 2010 (CH) ..... 2090/10

(51) Int. Cl.
*B42C 5/02* (2006.01)

(52) U.S. Cl.
CPC ..... *B42C 5/02* (2013.01)

(58) Field of Classification Search
CPC ..... B42C 5/02
USPC ..... 412/30
See application file for complete search history.

(56) References Cited

U.S. PATENT DOCUMENTS 2,718,018 A * 9/1955 Hildmann ..... 412/13
3,280,413 A 10/1966 Robbins et al.

FOREIGN PATENT DOCUMENTS

| | | | |
|---|---|---|---|
| DE | 199 07 682 | A1 | 8/2000 |
| DE | 102 05 676 | A1 | 8/2003 |
| EP | 0676303 | A1 | 10/1995 |
| EP | 1872963 | A2 | 1/2008 |
| GB | 630 529 | A | 10/1949 |
| GB | 751 222 | A | 6/1956 |
| GB | 844 651 | A | 8/1960 |

OTHER PUBLICATIONS

DE 199/07/682 Translation from doc published Aug. 24, 2000.*
International Search Report issued in CH 2090210, dated Mar. 29, 2011.
European Search Report issued in European Application No. 11 19 3159 dated Feb. 7, 2012.

* cited by examiner

*Primary Examiner* — Kyle Grabowski
(74) *Attorney, Agent, or Firm* — Venable LLP; Robert Kinberg

(57) ABSTRACT

A method and a device for pressing a book block over the rounded back of a book block having a longitudinal axis extending in the center and along the back. The book block is clamped between two clamping jaws of a clamping device, in a region adjacent to the back of the book block, parallel to the longitudinal axis of the back. A pressing device presses a pressing member against the back, wherein the pressing member is placed approximately in the center of the back onto the book block back. At least a section of the pressing member is then moved across the back. Once the pressing member, which is oriented parallel to the longitudinal axis of the back, is placed onto the back it then moves along at least one continuously preselected movement path over the back.

36 Claims, 9 Drawing Sheets

METHOD AND DEVICE FOR PRESSING A BOOK BLOCK

CROSS-REFERENCE TO RELATED APPLICATIONS

This application claims the priority of Swiss Patent Application No. 02090/10, filed on Dec. 15, 2010, the subject matter of which is incorporated herein by reference.

BACKGROUND OF THE INVENTION

The present invention relates to a method for pressing a book block with a rounded back, as well as to a pressing device as defined and a book production line provided with a device of this type.

For standard book block production, several signatures and/or individual sheets are bound together, for example, wherein each individual signature or sheet contains several pages of a book. Alternatively, individual pages can also be bound directly. For the production of book blocks, the signatures or sheets are initially stacked together until a desired number of pages for a book block have been gathered. The signatures in a book block are placed precisely one on top of another and are bound along the back, to create a joint and flat book block back. The same operational steps are used for an alternative production where individual pages are bound, so that a book block with a flat book back is created.

During a following method step, the rounding operation, the signatures and/or individual sheets are displaced parallel to each other and perpendicular to the book back. In the center portion, the backs of the signatures or folded sheets are thus displaced, relative to each other, and change from the flat book block back to form a rounded book block back. Different rounding methods can also be used besides the previously described rounding principle using rollers, for example the so-called hammer-bar principle.

Methods are furthermore known from European patent documents EP 1872963A2 and EP 0676303B1 for which, following the rounding step, a previously rounded book block that is clamped in along the back area is mechanically compressed using known, bar-type rams as tools.

The replaceable tools used for the known pressing operation, which for the most part are embodied concave and are inserted into a pressing bar, are spaced close together and are replaced to match the rounding of the book block back. The tools are normally replaced manually in a time-consuming and involved process.

However, a book production line used for an industrial production of books requires a fast, automatic setup of each device along the book production line for the changeover to a new order, especially for micro editions or small editions, wherein these are understood to include the so-called on-demand orders and the single-book production orders. This process is hindered whenever manual steps are required for the setup.

A manual process is disclosed in. U.S. Pat. No. 3,280,413A for which a pressing operation is realized with the aid of a massive roller. A book block is initially inserted manually into the machine, with the back pointing downward so that the book block is placed above the roller and aligned with its length. The book block remains in the same position for the operational steps of rounding and pressing and is subsequently removed manually from this position, wherein this process requires the joint operation of rounding and pressing tools.

According to this solution, the book block is clamped-in with rounding devices between two bars. For the rounding of the back, the movements of the bars and the movements of the rounding devices are coordinated. The rounding of the back is determined by scanning the thickness of the inserted book block, as well as with the aid of a manually preset value. The scanning provides a movement curve for the roller used to press the back. The roller alternately passes over the book block clamped into the pressing position, in part multiple times, by moving along a bow-shaped path that is adapted to the back rounding. However, this solution requires an extremely high mechanical expenditure and results in very low productivity because the rounding and pressing operations take place at one and the same location.

Furthermore known are different pressing members which, in particular, are embodied as replaceable tools such as rollers or plates and are either pressed only vertically against the back of the book block, or when using a combined pressing and rounding device by following a scan and sweeping across the back.

SUMMARY OF THE INVENTION

It is an object of the present invention to provide a method and a device for high-quality pressing of a book block which can be realized automatically and/or can be operated automatically and does not require the replacement of tools for each order change.

The above and other objects are accomplished by the invention by the provision of a method for pressing a book block having sides, a rounded back, and a longitudinal axis extending along the back, the method including, according to one embodiment: clamping the book block in between two clamping jaws on both sides of the book block in a region adjacent to the back and parallel to the longitudinal axis of the rounded back; moving a pressing member perpendicular to the longitudinal axis to bring the pressing member against the rounded back of the book block approximately in the center of the rounded back; and subsequently moving the pressing member across at least a section of the back to press the book block parallel to the longitudinal axis along at least one movement path spanning a plane which is located perpendicular to the longitudinal axis of the back.

According to another aspect of the invention there is provided a device for pressing a book block with a rounded back and a longitudinal axis that extends along the back, comprising, according to one embodiment: a locally fixed frame; a clamping device including two clamping jaws securable in a clamping position, relative to the locally fixed frame, to clamp the book block between the clamping jaws on both sides of the book block in a region adjacent to the back and parallel to the longitudinal axis of the back; and a pressing device including a pressing member oriented parallel to the longitudinal axis of the back, wherein the pressing device is operative to move the pressing member vertically inside the locally fixed frame perpendicular to the longitudinal axis against the back and to move the pressing member approximately parallel to the rounded back to follow a continuously preselected movement path which is located in a plane that spans perpendicular to the longitudinal axis.

The book block to be pressed with the method and/or with the device has a rounded back, as well as a longitudinal axis extending along the back, and is subjected to the successive method steps according to the invention which are described in the following.

The book block is initially clamped in between two clamping jaws on both sides and parallel to the longitudinal axis of the rounded back, in a region adjacent to the back. Following this, a pressing member is moved at least once against the rounded back of the fixedly clamped-in book block and, in the process, is placed perpendicular to the longitudinal axis and in the center, or at least approximately in the center, onto the rounded back. During the following pressing operation, the pressing member is moved over at least a section of the back. In the process, the pressing member presses or squeezes the book block parallel to the longitudinal axis across the back, wherein the pressing member follows at least one continuously pre-selectable movement path in a plane that is spanned perpendicular to the longitudinal axis of the back.

Pre-selectable in this case means that the path can conform to earlier processes or the requirements to be met by an order change through the adaptation of parameters for the method and/or the device. Pre-selectable also means that these adaptations are used to control the pressing device prior to or while the book block is clamped in. An adaptation of this type can furthermore be required for quality reasons during the processing of an order, for example if the book production speed varies.

The device according to the invention comprises a clamping device and a pressing device. In the clamping device, two clamping jaws are arranged parallel to each other. A feed device raises or lowers the book block to the correct position between the clamping jaws so that the longitudinal axis of the back is aligned parallel to the clamping jaws. The clamping jaws are used for clamping in the book block on both sides. The clamping jaws are positioned so as to move toward each other, normally in a horizontal direction, so that the book block can be clamped in between these two clamping jaws, in an area adjacent to the back.

The pressing device comprises a movably positioned pressing member and causes a vertical movement of the pressing member, perpendicular to the longitudinal axis, against the book block back, as well as to lift the pressing member off the book block. In the process, the pressing member which is aligned parallel to the longitudinal axis of the back can be placed in a pre-selectable position onto the back.

In the position assumed by placing it onto the back, the pressing member in the pressing device can be moved across the book block back by following a movement path that can be preselected in the pressing device. The movement path is located in a plane that is spanned perpendicular to the longitudinal axis of the back.

With the aid of this principle, a precondition is thus created for continuously changing pressing operations, or operations that can be changed with each cycle, in the field of industrial book production.

The pressing operation can be adapted in this way to the product without any manual intervention by using a method which realizes simple movement sequences with only a few components. As compared to the prior art, processes which previously were combined in complicated apparatuses, are separated into method steps which can be controlled automatically. Method steps which according to the prior art required a change in tools, could be replaced and the respective setup times dispensed with. The device can thus react more flexibly to faster changes in the requirements than has been possible so far.

The pressing movement normally starts when the pressing member is placed onto the book block back, either in the center or near the center, and then describes a curved path. As a result of the path followed by the pressing member, extending from the center of the book block back toward the outside, material is displaced from the book block back. This material displacement is accompanied by a plastic deformation of the back, thereby making it possible to achieve the desired pressing effect.

By using continuously preselected movement paths, it is thus possible to assign a slightly different course for the return movement of the pressing member to the starting position. An undesirable deformation of the previously pressed back can thus be avoided, and a nearly ideal movement path with tangential contact of the pressing member can respectively be assigned at the upper point of the back to each optional rounding of the back.

The plastic deformation caused by the pressing member and supported by the clamping jaws, for example, can thus remain constant from the inside toward the outside. It is advantageous if the plastic deformation increases from the center of the book block toward the outside, thus facilitating the turning of the pages in the finished book while the back is stabilized by the plastic deformation.

Corresponding courses of the movement path can be stored and can be called up with reference to the product, or they can be derived from format parameters of the products to be generated, thus making possible an automated processing of micro editions, small editions and single book editions.

According to one embodiment of the method, the at least one movement path followed by the pressing member may be predetermined with the aid of a variable gear, wherein a first actuator acts upon this gear. The actuator adjusts the gear based on a specified variable before the pressing member is moved along the pre-selected, at least one movement path across the back of the book block. The gear in the form of a robust component can be integrated into the pressing device and be controlled continuously from the outside via the first actuator.

According to a different embodiment of the method, the pressing member may be initially moved in a first section along one of the movement paths from the center of the back toward the outside to a first side of the book block, before the pressing member is lifted off the book block back and, following a different movement path, is once more moved toward the center of the back, but without making contact with the back. There, the pressing member is again placed onto the back of the book block and, following at least one additional section of one of the movement paths, presses the back by moving from the center toward an opposite-arranged second side of the book block.

According to a another embodiment of the method, the pressing member may be moved along its path from at least one of the two sides of the book block toward the center of the back along a path having a different radius than the movement path of the pressing member when it moves from the center of the back toward the other of the two sides of the book block. If the movement path of the pressing member toward the center of the back has a larger radius, then the operation of lifting the pressing member off the back is advantageously integrated into the respective movement path. This type of pressing operation avoids problems with a section of the back that has already been pressed, for example problems caused by moving across the same section in the reverse direction. Of course, the pressing member can also be moved along a path toward the center of the back which has a smaller radius as compared to the movement path taken during the previous pressing operation, thereby advantageously resulting in a further pressing of the book block.

According to yet another embodiment of the method, the at least one movement path of the pressing member is determined with the aid of a control unit and based on book block parameters which are transmitted to the gear with the aid of the first actuator. This concrete design option makes it possible to react to changes in the flow of products that are preferably conveyed through the book production line while dispensing with a corresponding sensor arrangement.

According to another embodiment of the method, the pressing member presses at least one section of the back multiple times. The first actuator of the gear can furthermore make adjustments during the pressing operation, for example so that the section can be pressed each time with increased pressure. Using multiple movements across the back can be advantageous when using specific materials. If the same pressure were to be applied in those cases during a single movement across, or expressed differently during a single pressing operation, it could possibly result in destruction. The advantage in that case, if applicable, lies in the quality improvement, wherein this provides the option of reacting in particular to changes in the material selection.

According to a different embodiment of the method, the movement path and/or the movement paths is or are determined in dependence on a single or several book block parameters, such as width, the material or the type of book block binding, or the curvature of its back.

Another embodiment of the method provides that during the pressing operation, the pressing member can be moved against a resistance on the back, independent of the preselected movement path, to realize an overload protection and avoid exceeding a maximum pressure by deviating from the movement path. An overload protection of this type ensures a high quality level and a high operating safety.

According to another embodiment of the method, the gear is displaced together with the pressing member in the vertical direction along a locally fixed frame. Placing the pressing member onto the back and lifting it off the back is thus possible without requiring a change in the positioning of the pressing member in the gear. For the adjustment in the vertical direction, only a control unit and an actuator embodied as a drive are needed. A format adjustment device can additionally be provided for the superimposed vertical movement of the pressing member. Depending on one of the book block parameters, for example the thickness of a book block, the above described action of placing on and lifting off the pressing member is corrected by shortening or lengthening a distance between a locally fixed point and the pressing member in the vertical direction, using a vertical adjustment element.

Different embodiments of the method require that the gear for moving the pressing member is provided for a first exemplary embodiment with at least two gear elements cooperating with two cam grooves, respectively, wherein these gear elements may comprise drive members which can be displaced horizontally and symmetrically relative to each other with the aid of the first actuator. According to a second embodiment, the gear is provided with at least two gear elements embodied as levers, which can be moved with the first actuator in the horizontal direction and symmetrically toward each other or away from each other. These gear elements are respectively provided with a crank lever positioned rotating in a pivot point. The pressing member is positioned with the aid of a crosshead in the cam grooves and/or in the crank levers. These gears are used for preselecting the movement path in that the first actuator moves the gear elements horizontally toward each other or away from each other.

The two exemplary embodiments for the gear conversion basically produce the same effect. The first embodiment, so to speak, represents a simplification as compared to the second embodiment since it does not require hinge points. Also considered as alternative embodiments for the conversion can be gears provided with linkage, crank and rocker arm, wherein the exemplary embodiments can furthermore be realized with several gear components, for example with four gear elements.

According to yet another embodiment of the method, once the gear elements have been moved, if applicable relative to each other, the crosshead may move along the movement paths predetermined by the cam grooves according to the first exemplary embodiment. A gear adjustment of this type is required, for example, when changing from a thin to a thicker book block or if the book block backs are rounded differently. According to the second exemplary embodiment, the gear elements embodied as levers are initially displaced relative to each other, if applicable. For both exemplary embodiments, the first actuator acts only in the horizontal directions onto the two gear elements. Following this, a different movement path for the pressing member is thus adjusted each time in the gear.

The pressing member according to one embodiment of the device has a flat pressing surface that is facing the back of the book block. The pressing member of alternative embodiments comprises a convex pressing surface that faces the book block back to be pressed, wherein this pressing member is may be embodied as a partial or full cylinder. The surface of the pressing member may be fluted, grooved, or smooth. The device therefore offers high flexibility with respect to the design for the pressing member. A change in the pressing member as a result of an order change is therefore omitted.

The pressing member of yet another embodiment of the device according to the invention is provided with a gear that can be varied with the aid of a first actuator.

The gear of another embodiment may be arranged together with the pressing member in a pressing device. The pressing device is positioned to be vertically displaceable inside a locally fixed frame.

For industrial book production, it is consequently no problem to supply book blocks to the device if, for example, the pressing device is lifted off in the upward direction. Also possible is a compensation of a position change of the pressing member in the vertical direction, caused by a gear adjustment with the aid of a second actuator. The pressing device and the pressing member can either be adjusted jointly with a single actuator or separately with separate actuators. The second actuator furthermore comprises an overload function in the vertical direction, thus making it possible to avoid damage to the pressing member.

According to a different embodiment, the gear is provided with two gear elements which can be adjusted with the first actuator in the horizontal direction and symmetrically to each other. These types of gears are robust and cost effective.

As previously described in connection with the method, the gear elements can be embodied as horizontally displaceable drive members. The gear may be provided with an inner and an outer gear element, wherein the inner gear element is arranged at least in part inside the outer gear element, as seen along the longitudinal axis of the back. Each gear element may be provided in the direction of the longitudinal back axis with respectively at least one cam groove, arranged on opposite ends of the book block back, wherein the pressing member can engage with the aid of a crosshead into the cam groove. The pressing member can therefore be moved perpendicular to the back of the book block.

Alternatively, the gear elements which are respectively provided with a pivot point can be adjusted symmetrically to each other and can be moved toward each other or away from each other. Respectively one crank lever is positioned rotating in the pivot points, wherein a crosshead which can be connected to these crank levers is aligned parallel with the longitudinal axis of the back and is also connected to the pressing member. A crank gear is thus realized since the pivot points of the gear elements with therein positioned crank levers are arranged at a distance to the crosshead.

According to a different embodiment, the crosshead and the pressing member are embodied integrally, that is as a unit.

A component of this type can be produced easily and cheaply, as well as rigid over the complete length, thereby counteracting a bending of the pressing member. Alternatively, the pressing member which has an axis can be positioned with both ends in the crosshead, such that the pressing member is rotatable around about its axis.

According to a different embodiment, the crosshead is actually embodied as bearing plates for the pressing member, which plates are positioned on both ends of the pressing member. Each plate is provided with respectively at least two hinge points on each end of the pressing member. The hinge points are located at a distance to the center of the pressing member, as seen in axial direction thereto. Depending on the exemplary embodiment, each hinge point contains respectively either a tilt lever or a crank lever which is movable. According to the first exemplary embodiment, the tilt lever is guided in respectively one of the cam grooves. According to the second embodiment, respectively one of the crank levers is positioned movable in one of the bearing points.

The tilt lever according to one embodiment is embodied as a roll plate. The roll plate is provided with rolls facing the cam groove, wherein these rolls are designed to engage in the cam groove. Facing away from the cam groove, the roll plate is provided with an articulated holder for the pressing member, wherein the pressing member may be held indirectly and in an off-center position.

According to a different embodiment, a drive is provided as the first actuator which is designed to act upon the gear with the aid of a single horizontal adjustment element, in particular a spindle, thus realizing a precise and reliable adjustment of the pressing member.

For the pressing of the back, the pressing member of a different embodiment can be driven with the aid of a rocking mechanism along the movement path.

The pressing device of yet another embodiment is connected to an overload unit, such that the overload unit is arranged between the pressing member and the frame for the device. The overload unit preferably comprises a spring package which is designed to act upon the pressing member in both horizontal directions, parallel to the movement direction of the gear. In case of an overload, the spring package allows the pressing member to deviate from the preselected movement path and thus avoid damage to the pressing member.

The device may be used in conjunction with a book production line.

BRIEF DESCRIPTION OF THE DRAWINGS

These and other features and advantages of the invention will be further understood from the following detailed description with reference to the accompanying drawings, wherein.

DETAILED DESCRIPTION

For reasons of a better overview, not all reference numbers are entered into all the Figures.

Figure 8:
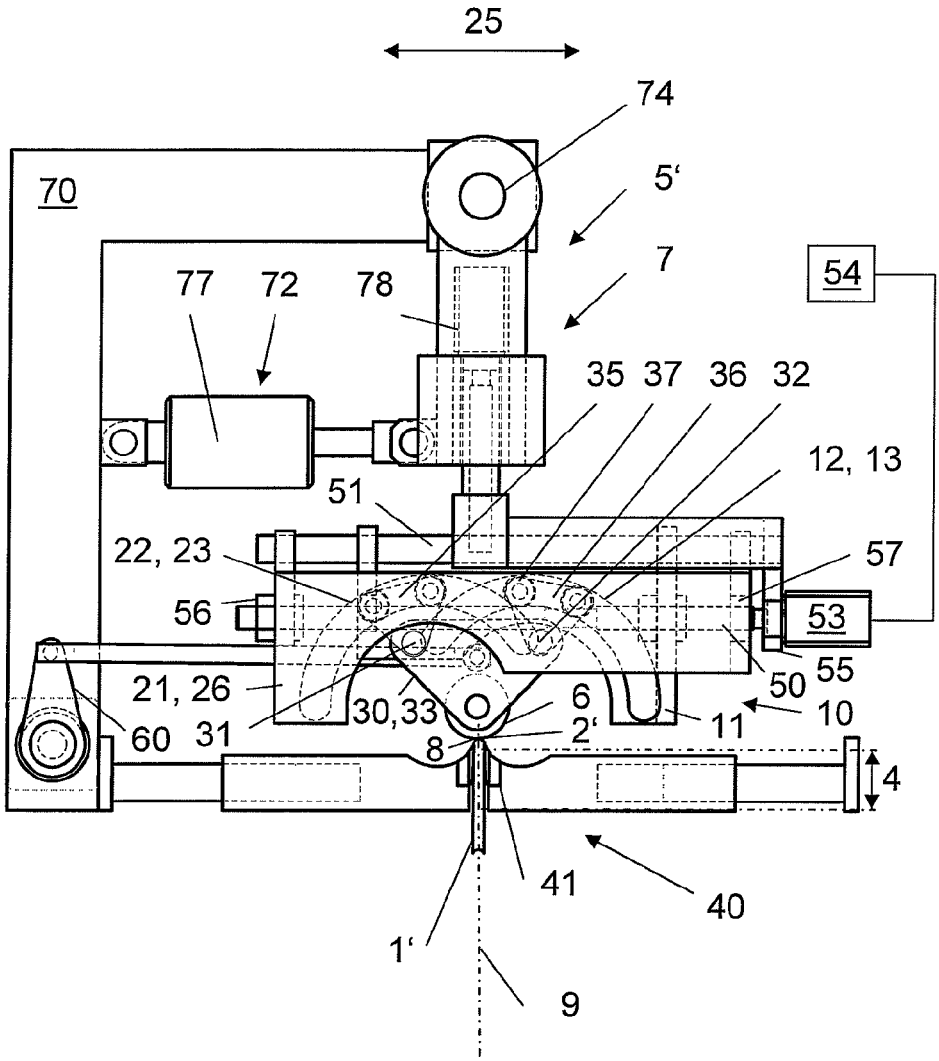
FIG. 8 is a view from the side of the device according to FIG. 2, showing a narrow book block and a correspondingly adjusted gear.
Figure 9:
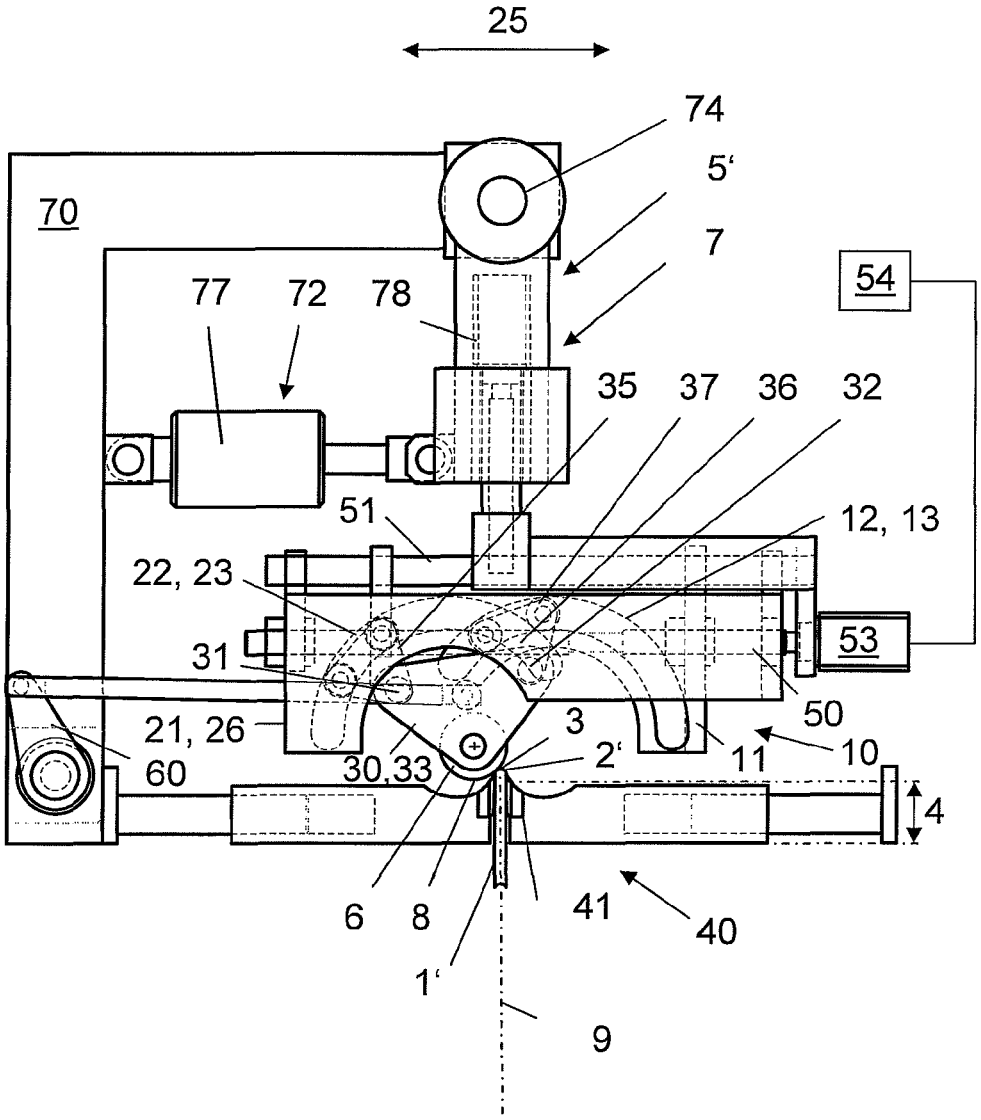
FIG. 9 is a view from the side of the device shown in FIG. 8, with the pressing member moved toward the left.

FIGS. 1-4 and 7-9 represent a first exemplary embodiment of a device 5 according to the invention, wherein the device contains a clamped-in book block 1, 1'. FIGS. 1-4 and 7 on the one hand and FIGS. 8 and 9 show respectively two different formats for the book blocks. That is to say, the book block 1 in FIGS. 1-4 and 7 is thicker than the thinner book block 1' according to FIGS. 8 and 9.

The book block 1, 1' to be pressed with the aid the device 5 has a rounded back 2, 2' with a longitudinal axis 3 along the back 2, 2' which is formed by an intersecting line of a center plane 9 through the book block 1, 1' with the rounded back 2, 2'.

Figure 1:
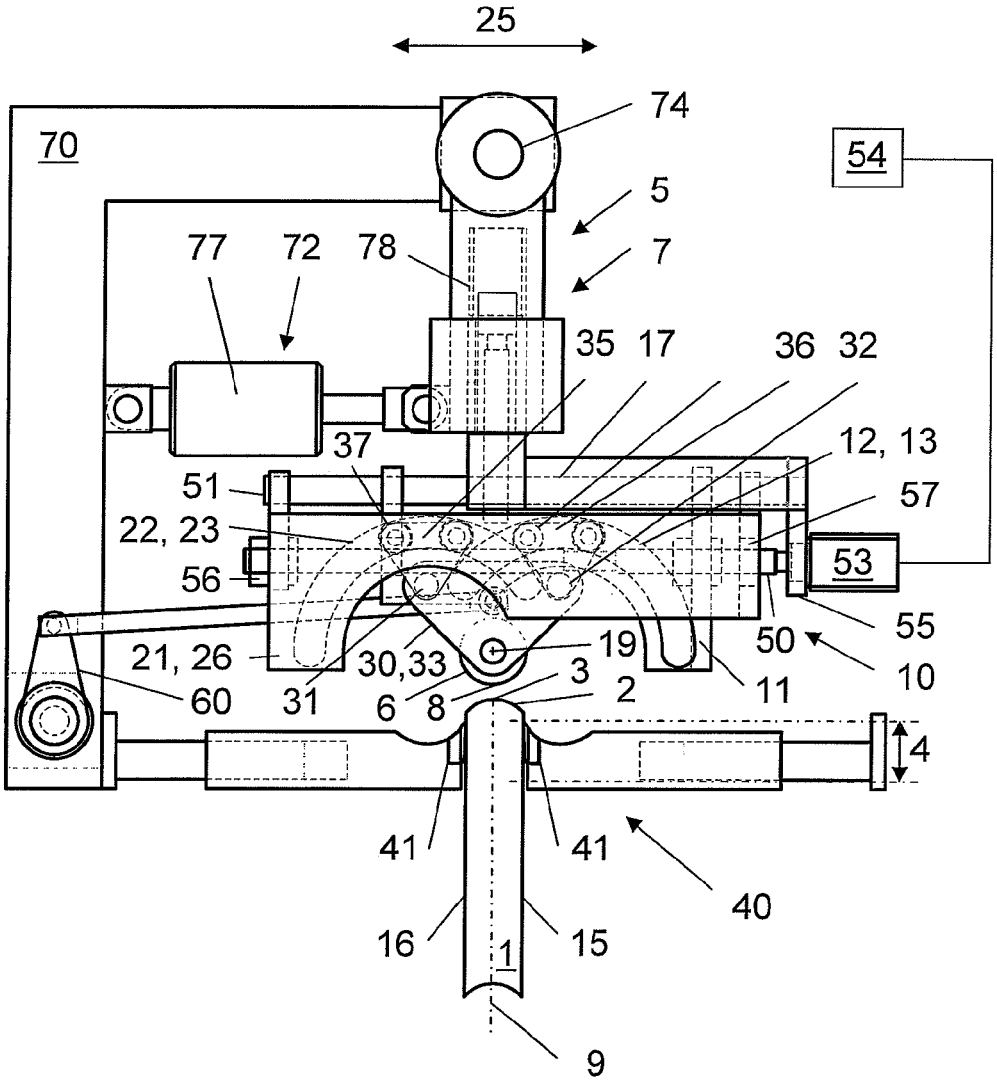
FIG. 1 is a view from the side of a first exemplary embodiment of a device according to the invention, with a pressing member arranged in the center above a book block and lifted off the book block.
Figure 2:
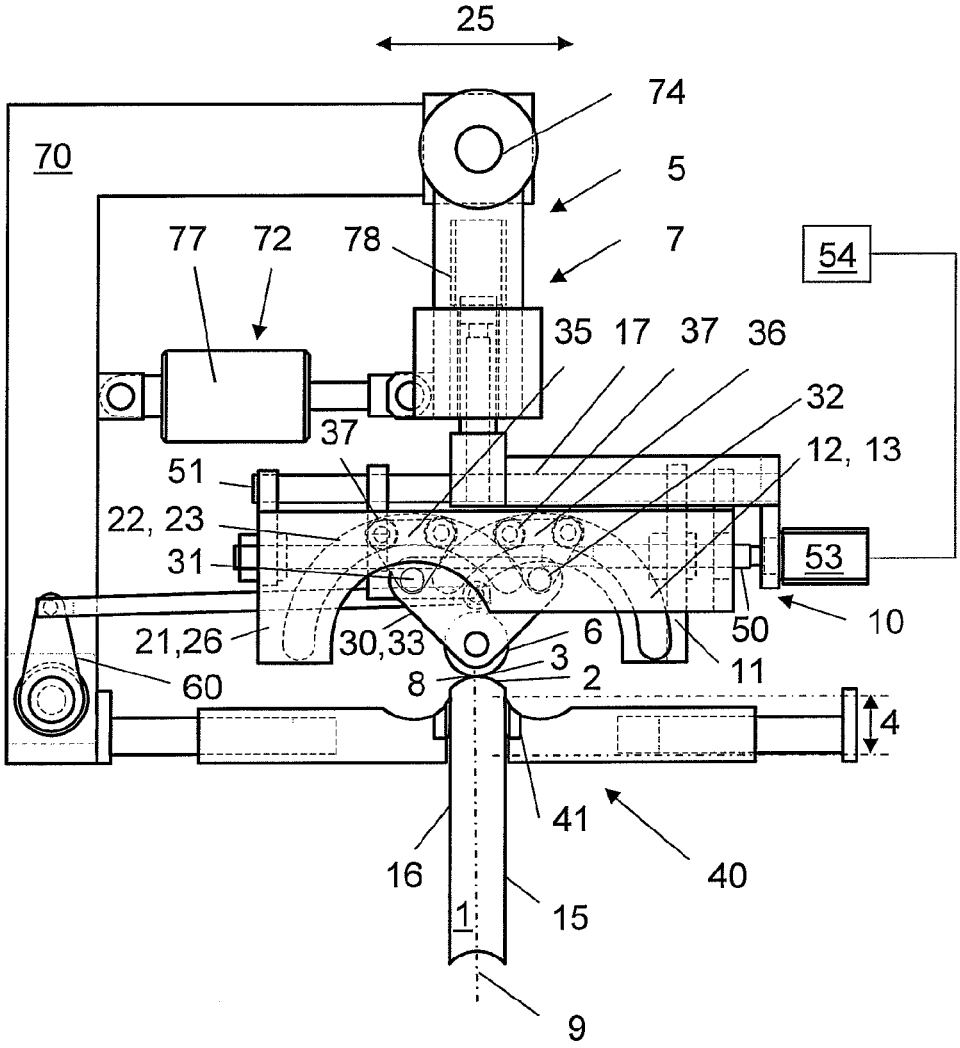
FIG. 2 is a view from the side of the device according to FIG. 1, with the pressing member placed onto the book block.
Figure 3:
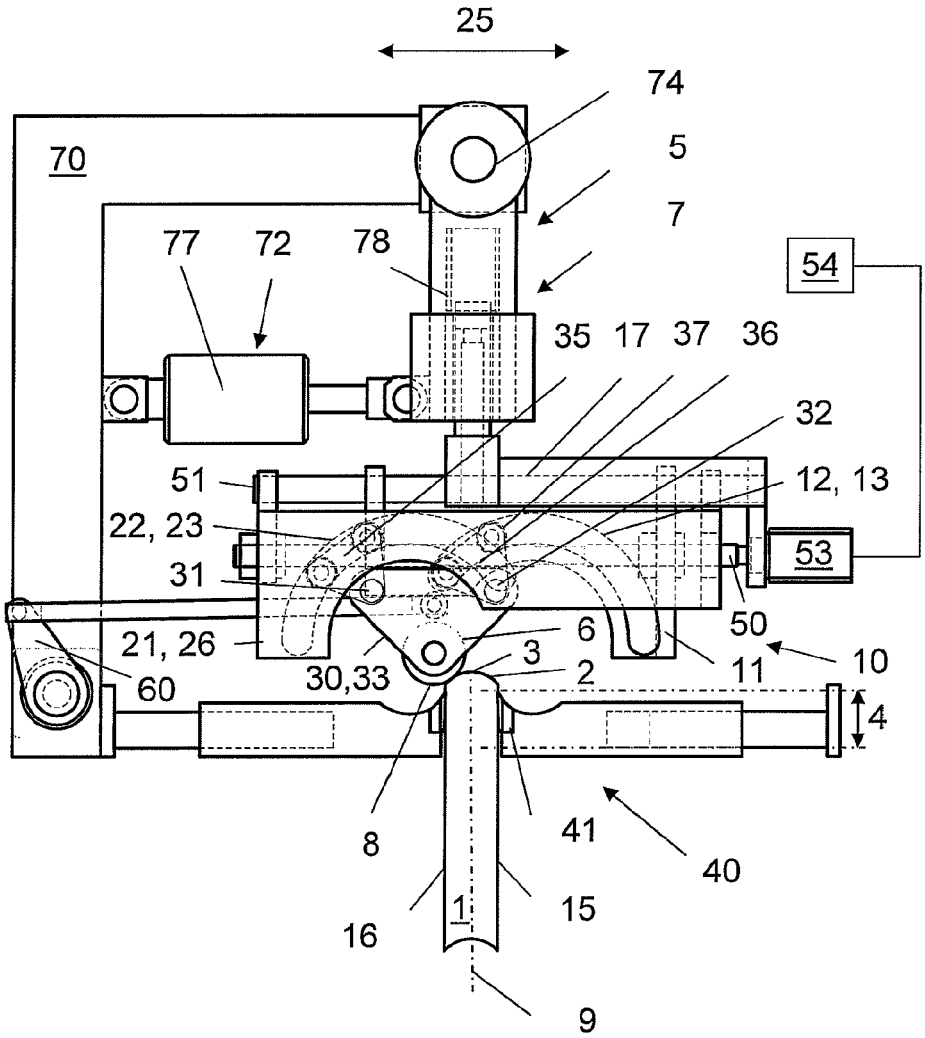
FIG. 3 is a view from the side of the device according to FIG. 2, with the pressing member moved toward the left.
Figure 5:
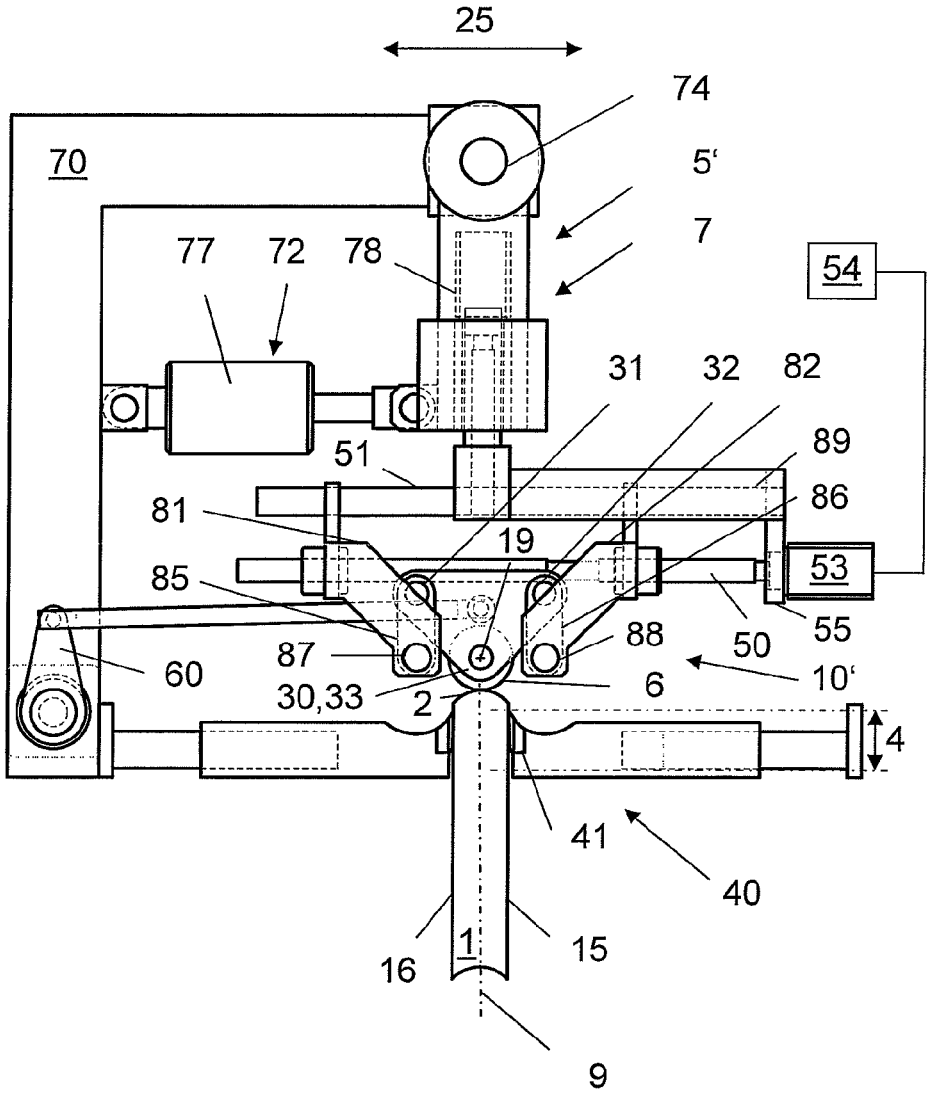
FIG. 5 is a view from the side of a second exemplary embodiment of the device, showing a pressing member arranged in the center above the book block and resting on the book block.
Figure 6:
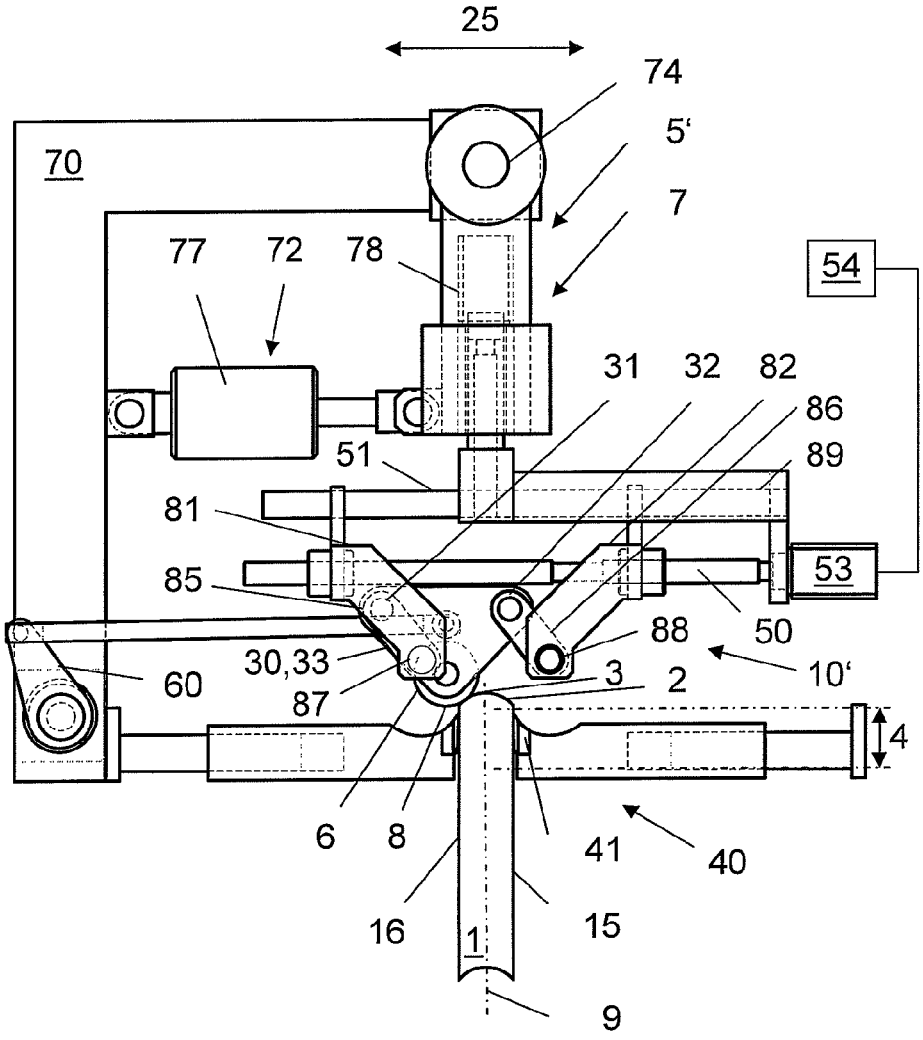
FIG. 6 is a view from the side of the device according to FIG. 5, with the pressing member moved toward the left.
Figure 7:
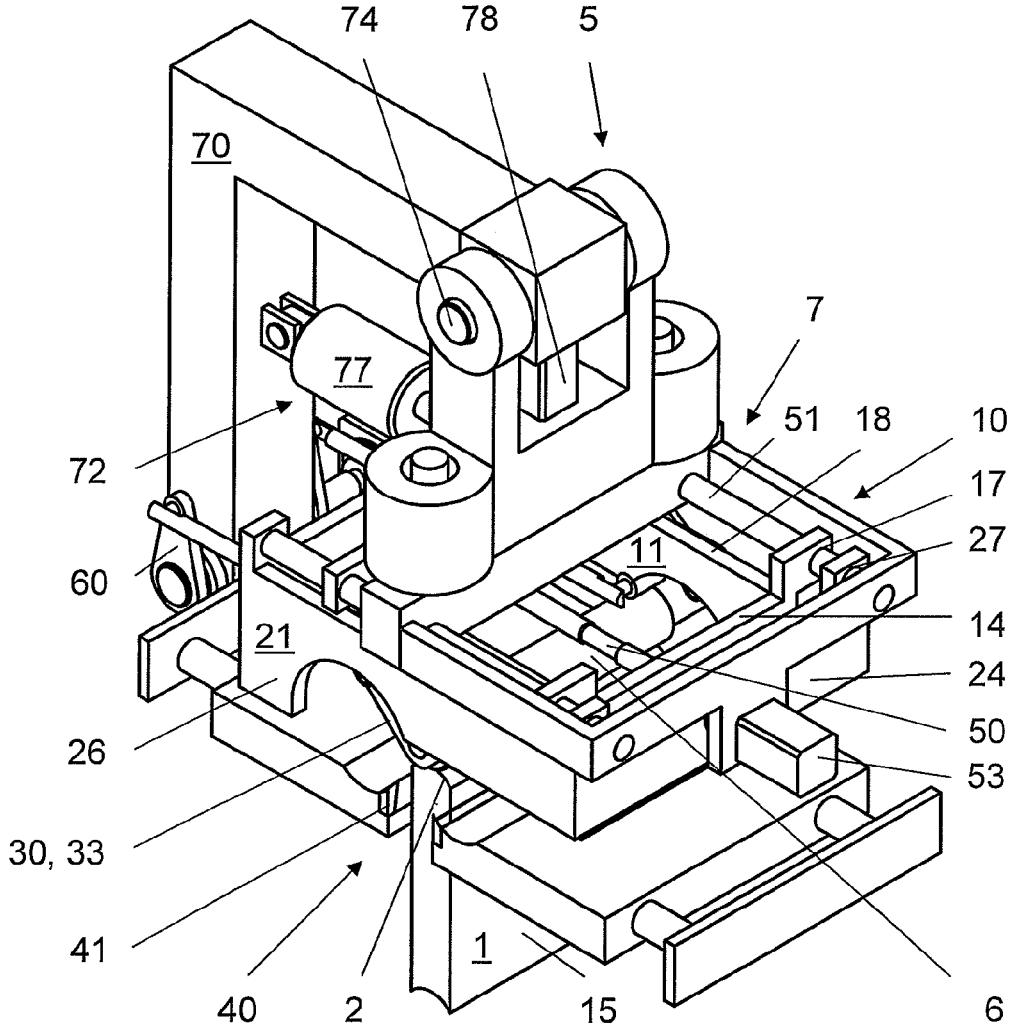
FIG. 7 is a perspective view of the device according to FIG. 2.

FIGS. 5 and 6 illustrate a second exemplary embodiment of a device 5' according to the invention in the positions shown in FIGS. 2 and 3. The second exemplary embodiment differs from the first exemplary embodiment with respect to a variable gear 10, 10' that is installed in a pressing device 7.

The installation of the pressing device 7 is identical for both embodiments, meaning the device is vertically movable with the aid of a second actuator 78, inside a locally fixed frame 70 of the device 5, 5'. In addition, the pressing device 7 is also suspended from a frame joint 74.

The device 5, 5' includes a clamping device 40 for the book block 1, 1' below the pressing device 7 in the frame 70. Two clamping jaws 41 are arranged parallel to each other in the clamping device 40. The book block 1, 1' is oriented with its back 2, 2' facing upward toward the pressing device 7 and is arranged between the clamping jaws 41, so that the longitudinal axis 3 is aligned parallel to the clamping jaws. The clamping jaws 41 are positioned movable in the horizontal direction, so that the book block 1, 1' can be clamped in by these clamping jaws 41 on both sides in a region 4 adjacent to the back block back and can be secured in place, relative to the frame 70.

A pressing member 6 of the pressing device 7 can be used to apply pressure in the vertical direction onto the back 2, 2', which is made ready in foregoing way. The pressing device 7, provided for this operation, serves to move the pressing member 6 in the vertical direction, perpendicular to the longitudinal axis 3, against the back 2, 2' of the book block 1, 1'. According to the positions shown in FIGS. 2 and 5, the pressing device 7 with the pressing member 6, which is oriented parallel to the longitudinal axis 3, comes to rest approximately in the center of the back 2, 2', meaning in the center of the rounded back 2, 2' or in a region adjacent the center of the back 2, 2'.

The pressing member 6 illustrated in the exemplary embodiments is housed inside the pressing device 7, such that it can rotate around an axis 19 and can be moved continuously along an approximately horizontal movement track, not shown herein, which can be preselected. In the position which it assumes after coming to rest on the book block back, the pressing member 6 can be moved along the movement path over the back 2, 2' of the book block 1, 1'. The movement path, which is located in a plane that is spanned perpendicular to the longitudinal axis 3 of the back 2, 2', represents an at least approximately circular path that follows the at least approximately circular path extending along the rounding of the back 2, 2'.

The coordination of the approximately horizontal movement along the movement path is handled by the gear 10, 10'. The gear 10, 10' is arranged in the pressing device 7 and can be moved vertically up and down together with this pressing device inside the frame 70.

An overload unit 72 is connected in the horizontal direction between the pressing device 7 and the frame 70. The overload unit 72 is provided with a spring package 77 which is effective in both horizontal directions, parallel to a movement direction 25 of the gear 10, 10'. If the pressure exerted onto the book block 1, 1' is too strong, the spring package 77 resiliently moves toward a spring resistance, meaning the pressing device 7 evades accordingly.

The further description is based on the assumption of a vertical positioning for the pressing device 7 in which the pressing member 6 is already in contact with the back 2, 2'. The pressing member 6 shown in the Figures is embodied as a full cylinder with a convex pressing surface 8, wherein partial cylinders, ranging up to a pressing member with a flat pressing surface, can alternatively also be used.

The gear 10, 10' for both exemplary embodiments is provided with two gear elements 11, 21; 81, 82 which can be adjusted continuously horizontally and symmetrical to each other with the aid of a first actuator 53. The necessity for adjusting the gear 10, 10' in this way follows from a direct comparison of FIGS. 3, 6 and 9 which show the pressing member 6 in a state where it is moved toward the left. FIGS. 3 and 9 differ with respect to the thickness of the book block 1, 1' and, of course, also the width of the back 2, 2'. The movement path of the pressing member 6 is determined with a control unit 54, connected to the first actuator 53, so as to conform to the thickness of the book block 1, 1', and is transmitted via the first actuator 53 to the gear 10, 10'. Of course, the movement path of the pressing member 6 can also be determined in dependence on a different book block parameter, such as the material or the type of binding used for the book block 1, 1' or the curvature of its back 2, 2', wherein a combination of several book block parameters can also be used for determining the movement path of the pressing member 6.

According to the exemplary embodiments shown herein, a drive is provided as actuator 53 for the variable gear 10, 10' and is embodied so as to act upon the gear 10, 10' with the aid of a single horizontally arranged adjustment element 50, for example embodied as a spindle.

According to the first exemplary embodiment, horizontally displaceable drive members are provided as gear elements 11, 21 which can be adjusted symmetrically relative to each other. An inner gear element 11 in this case is arranged inside an outer gear element 21, as seen along the longitudinal axis 3 of the back 2, 2'. The gear elements 21, 11 can be displaced, relative to each other, in horizontal movement direction 25 of the gear 10 and thus perpendicular to the longitudinal axis 3 of the back 2, 2'. In vertical planes on both ends of the pressing member 6, the gear elements are provided parallel to the movement direction 25 with spaced-apart front walls 26 and rear walls 18. The front walls and rear walls 26, 28 together with the side walls 14, 24, which are aligned parallel to the longitudinal axis 3 of the back 2, 2', respectively form a cube (see FIG. 7), as seen in the cross section.

The side walls 14, 24 are provided with through holes 17, 27, arranged congruent, for accommodating guide rods 51 which can be displaced in movement direction 25 of the gear 10. According to the second exemplary embodiment (FIGS. 5 and 6), the through holes 17, 27 are located inside a guide 89 for the gear elements 81, 82. In both embodiments, a mounting plate 55 is attached to the ends of the guide rods 51 on one side. This mounting plate 55 supports the first actuator 53 for the adjustment element 50, arranged parallel to the guide rods 51 that are provided with two regions of opposite-directed threads which are not shown in further detail herein. In the first embodiment, the outer gear element 21 engages with a first spindle nut 56 in the thread in one of the regions. The inner gear element 11 engages with a second spindle nut 57 into the thread of the second region (FIG. 1; FIG. 8). With the same pitch for the threads, a rotation of the adjustment element 50 results in symmetrical movements to the book block 1, 1' in the horizontal movement direction 25.

According to the embodiment, respective gear elements 11, 21 are provided with a cam groove 12, 13, 22, 23 in the front and rear walls 26, 18, which are arranged on opposite sides as seen in the direction of the longitudinal axis 3 for the back 2, 2. Each cam groove 12, 13, 22, 23 extends along an upper circular arc section, around a center that is not shown herein, wherein the centers are respectively oriented parallel to the longitudinal axis 3 of the back 2, 2' (see FIG. 4). The inner gear element 11 is provided with external cam grooves 12, 13 that face the outer gear element 21 while the outer gear element 21 is provided with internal cam grooves 22, 23 that face the inner gear element 11.

A plate 33 is disposed between the front walls 26 and the back walls 18 of the gear elements 11, 21, which plate is oriented parallel to the movement direction 25 and perpendicular to the longitudinal axis 3 of the back 2, 2'. This plate accommodates the pressing member 6 so that it can rotate at both ends around its axis 19. The two plates 33 jointly form a crosshead 30 and are not shown connected herein, but can alternatively also be connected.

Figure 4:
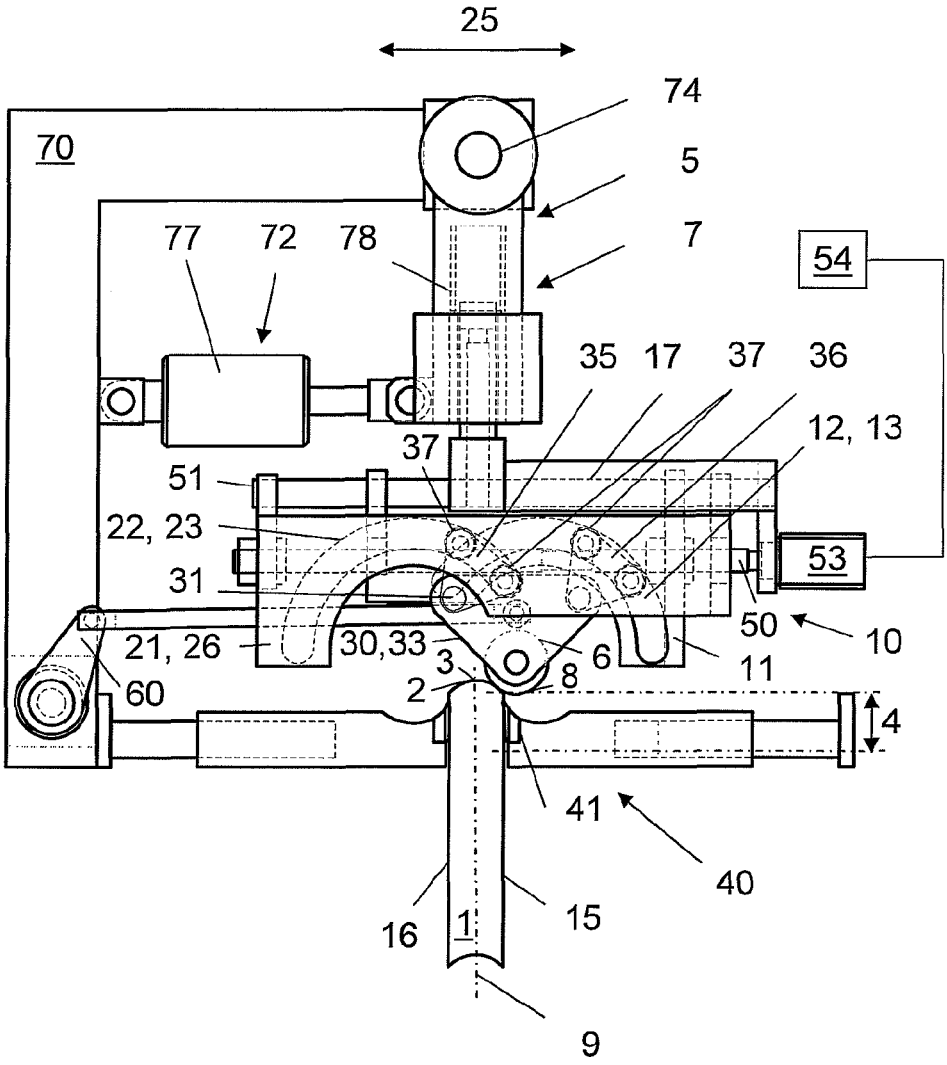
FIG. 4 is a view from the side of the device according to FIG. 2, with the pressing member moved toward the right.

Each of the plates 33 is provided on the left side and the right side with respectively one hinge point 31, 32 above the pressing member 6. A first tilt lever 35 that faces the outer gear element 21 is arranged pivoting in a first hinge point 31 and is embodied as a first roll plate. A second tilt lever 36, which is embodied as a second roll plate and is facing the inner gear element 11, is arranged so as to pivot in a second hinge point 32. In total, there are four tilt levers 35, 36; that is, each plate 33 is provided with two tilt levers located above the respectively associated hinge point 31, 32, and each tilt lever 35, 36 is further respectively provided with at least two rolls 37 (FIG. 4). The rolls 37 for each tilt lever 35, 36 are arranged such that they can engage completely in one of the cam grooves 12, 13, 22, 23. As a result, a certain lever effect can be transmitted via the rolls 37 to the roll plate 35, 36.

Alternatively and according to the second exemplary embodiment shown in FIGS. 5 and 6, four levers that are essentially symmetrical in pairs are embodied as gear elements 81, 82 which can be displaced symmetrical to each other. One pair of gear elements 81, 82, arranged on one side of the crosshead 30, is provided with a first and a second lever. The gear elements 81, 82 are respectively connected to respectively one of the hinge points 31, 32 in the plate 33 via a crank lever 85, 86 that is positioned pivoting in a hinge point 87, 88 of the gear element 81, 82

The lower ends of the gear elements 81, 82 move horizontally toward each other or away from each other when the gear 10' is adjusted, wherein the hinge points 87, 88 are arranged at the lower ends of the gear elements 81, 82.

The pressing member 6, which is connected in this manner or in a comparable manner to the crosshead 30, can be moved with the aid of a rocking mechanism 60 parallel to the longitudinal axis 3 of the back 2, 2', wherein a one-piece embodiment of the crosshead with the integrated pressing member is also conceivable. The rocking mechanism 60 drives the pressing member 6 along the movement path for pressing against the back 2, 2'.

To clearly illustrate the method according to the invention, the first exemplary embodiment is shown with the aid of the snapshots in FIGS. 2 to 4 for which the pressing member 6 rolls off the book back. FIG. 2 shows a starting position in which the pressing member 6 is placed along the longitudinal axis 3 onto the back 2, 2'. In FIG. 3, the pressing member 6 is moved to the left, toward the side 16, while in FIG. 4 it is moved to the right, meaning toward a first side 15 of the book block 1.

With respect to FIG. 4, the pressing member 6 is placed onto the book block in the same way as shown in FIG. 2, meaning in a first section of one of the movement paths where it is initially moved from the center of the back 2 toward the outside and the first side 15 of the book block 1. The pressing member 6 is then moved back along the same movement path toward the center of the back 2 before pressing the book block 1 in at least one additional section of one of the movement paths from the center toward the outside to a second side 16 (FIG. 3) which is arranged opposite the first side 15.

Alternatively, and following the pressing operation in the direction of the first side 15 of the book block 1, the pressing member 6 is first lifted off the back 2 of the book block 1 and, without making contact with the back 2, is then moved along a different movement path toward the center of the back 2 where it is again placed onto the back 2 and can subsequently be used for pressing the book block 1 toward the second side 16. In the process, the pressing member 6 on its path from at least one of the two sides 15, 16 of the book block 1 toward the center of the back 2 can be moved along a movement path which has a larger radius as compared to the movement path of the pressing member 6 on its way from the center to one of the two sides 15, 16 of the book block 1. The two described alternative solutions make it possible to avoid problems with a previously compressed section of the back 2. Of course, the pressing member 6 can also be moved along a path toward the center of the back 2 which has a smaller radius as compared to the movement path for the previous pressing operation, thereby advantageously permitting a further pressing of the book block 1.

The pressing of a thin book block 1', as shown in FIGS. 8 and 9, as well as the pressing of a book block 1 using a device 5' as shown in FIGS. 5 and 6 occurs essentially in the same way.

It will be understood that the above description of the present invention is susceptible to various modifications, changes and adaptations, and the same are intended to be comprehended within the meaning and range of equivalents of the appended claims.

What is claimed is:

1. A method for pressing a book block having sides, a rounded back, and a longitudinal axis extending along the back, comprising:

clamping the book block in between two clamping jaws on both sides of the book block in a region adjacent to the back and parallel to the longitudinal axis of the rounded back;

moving a single pressing member perpendicular to the longitudinal axis with the use of a pressing device arranged vertically displaceable within a locally fixed frame to bring the pressing member against the rounded back of the book block approximately in the center of the rounded back; and subsequently moving the single pressing member along a preselected movement path across at least a section of the back to press the book block parallel to the longitudinal axis with the use of an actuator and a gear comprising two gear elements symmetrical to each other, operatively coupled to the single pressing member and horizontally adjustable by the actuator, wherein the single pressing member is movable vertically by the pressing device and horizontally by the actuator and gear to guide the single pressing member approximately parallel to the rounded back so that the single pressing member is movable along a preselected movement path corresponding to a curvature of the back of the book block while applying pressure onto the back of the book block.

2. The method according to claim 1, including continuously adjusting the gear by the actuator based on a specified presetting variable, either before and/or during the movement of the pressing member across the back.

3. The method according to claim 1, wherein the subsequently moving step includes initially moving the pressing member in a first section of one movement path from the center of the back toward an outside on one side of the book block, lifting the pressing member off the back of the book block and without making contact with the back following a different movement path to return to the center of the back, subsequently placing the pressing member onto the back of the book block and, while following at least another section of the movement path, pressing the back from the center toward the outside on the other side of the book block.

4. The method according to claim 3, wherein the subsequently moving step further includes moving the pressing member on its path from at least one of the two sides of the book block toward the center of the back along a movement path with a different radius as compared to the movement path of the pressing member on its way from the center toward one of the two sides of the book block.

5. The method according claim 1, including determining the at least one movement path for the pressing member with aid of a control unit transmitting the determination via the actuator to the gear.

6. The method according to claim 1, including pressing the at least one section of the back multiple times with the pressing member.

7. The method according to claim 1, including determining the at least one movement path in dependence of a single book block parameter.

8. The method according to claim 1, including determining the at least one movement path in dependence of at least one of thickness, type of material used, type of binding used for the book block, and curvature of the back.

9. The method according to claim 1, wherein the subsequently moving step includes rotating the pressing member while it rolls off the back along the at least one movement path.

10. The method according to claim 1, wherein the subsequently moving step includes moving the pressing member during the pressing operation independent of the preselected movement path, counter to a resistance of the back to ensure an overload protection and to avoid exceeding a maximum pressure by deviating from the movement path.

11. The method according to claim 1, including displacing the gear jointly with the pressing member inside the locally fixed frame for placing the pressing member onto the back or for removing the pressing member from the back.

12. The method according to claim 1, including displacing the two gear elements symmetrical to each other with the aid of the actuator.

13. The method according to claim 12, wherein each gear element is pivotally coupled to one crank lever positioned rotatable about a hinge point, and the method includes positioning the pressing member with a crosshead operatively coupled to the crank levers, wherein the movement path of the pressing member is preselected through movement of the gear elements in the horizontal direction toward each other or away from each other with the aid of the actuator.

14. The method according to claim 13, including moving the crosshead along the movement path predetermined by a pivoting of the crank levers that follow a relative movement of the gear.

15. The method according to claim 1, wherein the gear elements include, respectively, at least two cam grooves, and the method includes positioning the pressing member with a crosshead that is operatively coupled to the gear elements via the grooves, wherein the movement path of the pressing member is preselected through movement of the gear elements in the horizontal direction toward each other or away from each other with the aid of the actuator.

16. The method according to claim 15, including moving the crosshead along a movement path guided by the cam grooves following a relative movement of the gear elements.

17. A device for pressing a book block with a rounded back and a longitudinal axis that extends along the back, comprising:

a locally fixed frame;

a clamping device including two clamping jaws securable in a clamping position, relative to the locally fixed frame, to clamp the book block between the clamping jaws on both sides of the book block in a region adjacent to the back and parallel to the longitudinal axis of the back; and a pressing device arranged vertically displaceable within the locally fixed frame and including: a single pressing member oriented parallel to the longitudinal axis of the back, an actuator and a gear and comprising two gear elements symmetrical to each other, operatively coupled to the single pressing member and horizontally adjustable by the actuator, wherein the single pressing member is movable vertically by the pressing device to apply pressure onto the back of the book block and horizontally by the actuator and gear to guide the single pressing member approximately parallel to the rounded back so that the single pressing member is movable along a preselected movement path corresponding to a curvature of the back of the book block while applying pressure onto the back of the book block.

18. The device according to claim 17, wherein the pressing member has a flat pressing surface.

19. The device according to claim 17, wherein the pressing member has a convex pressing surface.

20. The device according to claim 17, wherein the pressing member comprises at least a portion of a cylinder.

21. The device according to claim 17, wherein the pressing device further comprises a crosshead coupled to the pressing device, and the gear includes an outer gear element and an inner gear element arranged at least in part inside the outer gear element, as seen along the longitudinal axis of the back, and the gear elements include respectively one cam groove arranged on opposite ends of the pressing member as seen in the direction of the longitudinal axis into which the pressing member is positioned with the aid of the crosshead so that the pressing member is movable horizontally along the preselected movement path.

22. The device according to claim 21, wherein the gear elements comprise horizontally displaceable drive members.

23. The device according to claim 21, wherein the crosshead and the pressing member comprise a unit.

24. The device according to claim 21, wherein the pressing member has a rotational axis and has opposite ends positioned within the crosshead so as to rotate about the rotational axis.

25. The device according to claim 21, wherein the crosshead comprises two separate plates which are at least arranged on opposite ends of the pressing member and are operative to position the pressing member, wherein the separate plates, as seen in the axial direction of the pressing member, respectively include at least two hinge points outside of the center of the pressing member, each hinge point accommodating one tilt lever that is positioned movable inside one of the cam grooves.

26. The device according to claim 25, wherein the tilt levers each comprise a roll plate with rolls that engage in a corresponding one of the cam grooves.

27. The device according to claim 17, wherein the gear elements respectively include one pivot point and are movable in a horizontal direction toward each other or away from each other, and wherein the pressing device further includes respectively one crank lever positioned rotatable in each of the pivot points, and a crosshead having a longitudinal axis oriented parallel to the longitudinal axis of the back and connected to the pressing member and to the crank levers.

28. The device according to claim 27, wherein the crosshead and the pressing member comprise a unit.

29. The device according to claim 27, wherein the pressing member has a rotational axis and has opposite ends positioned within the crosshead so as to rotate about the rotational axis.

30. The device according to claim 27, wherein the crosshead comprises two separate plates which are at least arranged on opposite ends of the pressing member and are operative to position the pressing member, wherein the separate plates, as seen in the axial direction of the pressing member, respectively include at least two hinge points outside of the center of the pressing member, each hinge point accommodating one of the crank lever.

31. The device according to claim 17, wherein the pressing device further includes an adjustment element coupled to the gear, and the actuator comprises a drive that acts on the gear through the adjustment element.

32. The device according to claim 31, wherein the adjustment element comprises a spindle.

33. The device according to claim 17, wherein the gear comprises a rocker mechanism connected to drive the pressing member along the movement path for pressing the back.

34. The device according to claim 17, further including an overload unit connected between the pressing device and the frame.

35. The device according to claim 34, wherein the overload unit comprises a spring package arranged to act upon the pressing device in both horizontal directions, parallel to the movement direction.

36. A book production line comprising a device for pressing a book block according to claim 17.

* * * * *